United States Patent [19]

Odermann et al.

[11] 4,327,654

[45] May 4, 1982

[54] BASTING STITCH OVERTHROW SYSTEM

[75] Inventors: Charles R. Odermann, Montville; Robert B. Brauch, Wayne; Philip F. Minalga, Piscataway, all of N.J.

[73] Assignee: The Singer Company, Stamford, Conn.

[21] Appl. No.: 239,834

[22] Filed: Mar. 2, 1981

[51] Int. Cl.[3] ..... D05B 3/02; D05B 55/16

[52] U.S. Cl. ..... 112/158 E; 112/221

[58] Field of Search ..... 112/158 E, 158 R, 221, 112/73, 109, 111

[56] References Cited

U.S. PATENT DOCUMENTS 3,559,602 2/1971 Illes ..... 112/158 R 3,815,529 6/1974 Adams et al. ..... 112/158 R 3,847,100 11/1974 Garron ..... 112/158 E

*Primary Examiner*—Peter P. Nerbun

*Attorney, Agent, or Firm*—Edward P. Schmidt; Robert E. Smith; Edward L. Bell

[57] ABSTRACT

A linear motor is used to jog the needle bar and gate beyond the normal jogging range in order to disable a latch and separate the needle bar from the sewing machine driving means. The linear motor is driven into this abnormal excursion beyond the usual jogging motion by supplying a known needle position signal to the servoamplifier system for the linear motor and providing a separate voltage from a regulated voltage source which is summed with the specific signal in order to provide sufficient electromotive force for jogging the sewing needle beyond the normal jogging range.

2 Claims, 5 Drawing Figures

| DIGITAL CODE | ANALOG VOLTAGE | NEEDLE POSITION |
|---|---|---|
| 00000 | | UNUSED |
| 00001 | | |
| 00010 | | |
| 00011 | +0.960 | FULL LEFT NEEDLE POSITION |
| 00100 | +0.880 | |
| 00101 | +0.800 | |
| 00110 | +0.720 | |
| 00111 | +0.640 | |
| 01000 | +0.560 | |
| 01001 | +0.480 | |
| 01010 | +0.400 | |
| 01011 | +0.320 | |
| 01100 | +0.240 | |
| 01101 | +0.160 | |
| 01110 | +0.080 | |
| 01111 | .000 | CENTER NEEDLE STRAIGHT STITCH POSITION |
| 10000 | −0.080 | |
| 10001 | −0.160 | |
| 10010 | −0.240 | |
| 10011 | −0.320 | |
| 10100 | −0.400 | |
| 10101 | −0.480 | |
| 10110 | −0.560 | |
| 10111 | −0.640 | |
| 11000 | −0.720 | |
| 11001 | −0.800 | |
| 11010 | −0.880 | |
| 11011 | −0.960 | FULL RIGHT NEEDLE POSITION |
| 11100 | | UNUSED |
| 11101 | | |
| 11110 | | |
| 11111 | | |

BASTING STITCH OVERTHROW SYSTEM

BACKGROUND OF THE INVENTION

This invention relates to a basting stitch mechanism in a zigzag sewing machine wherein the needle bar is driven in endwise reciprocation through a latch mechanism affixed to the needle bar.

The prior art discloses in the U.S. Pat. No. 3,559,602 a basting stich mechanism in a zigzag sewing machine in which the needle bar is driven in endwise reciprocation through a latch connection to the sewing machine driving means. The latch connection is disabled by urging the needle bar to a lateral position beyond the sewing range by a suitably contoured cam.

In the U.S. Pat. No. 3,782,311, a modular needle bar gate arrangement was utilized with the above principle in which the latch was disabled by relative movement between the needle bar and the gate supporting the needle bar. The jogging motion beyond the normal range of jogging motion required to disable the latch was again derived from a suitably contoured cam.

With the advent of the electronically controlled sewing machine, jogging motion of the needle bar gate was effected by utilization of a linear motor, as is disclosed in the U.S. Pat. No. 3,984,745. At that time, in order to make the operation of the basting stitch device compatible with the electronic control devices, the latch disabling was accomplished by the use of a solenoid. A solenoid baste switch disabling mechanism is first disclosed in U.S. Pat. No. 3,847,100, and later in the U.S. Pat. No. 3,872,809. However, the solenoid actuated basting devices involve the use of a considerable number of additional parts and the solenoid itself, resulting in greatly increased costs. What is required is some means of implementing basting in an electronically controlled sewing machine at a minimum cost without the necessity for costly components.

SUMMARY OF THE INVENTION

The above requirement is achieved in the instant device in which the linear motor itself is used to jog the needle bar and gate beyond the normal jogging range to disable a latch and separate the needle bar from the sewing machine driving means. A known needle bar gate module is utilized in which the needle bar gate is supported in a supporting bracket by a lower pivot stud located forwardly of the needle bar and by a combination upper needle bar bearing and ball and socket arrangement. The needle bar gate extends forwardly of the needle bar, and jogging of the gate causes relative motion to take place between the gate and the needle bar. The needle bar supports thereon a latch mechanism having a latch with a forwardly extending ear. The gate supports thereupon a bracket which is arranged to interfere with a forwardly extending ear of the latch when the needle bar gate is jogged beyond the normal range of jogging motion. This jogging motion can be effected by a linear motor to separate the needle bar from the actuating mechanism causing endwise reciprocation; however, the 25 evenly spaced needle positions required to adequately effect ornamental patterns are obtained in a 5 bit, 32 position system which has insufficient capacity to provide an adequate overthrow of the linear motor beyond the normal range of jogging motion required to cause endwise reciprocation. This deficiency is remedied by providing a separate voltage source for the linear motor which is summed with a given input to the bight servo system to provide an adequate overthrow signal when a basting stitch is called for.

DESCRIPTION OF THE DRAWINGS

The novel features which are considered as characteristic for the invention are set forth in particular in the appended claims. The invention itself, however, both as to its construction and its method of operation, together with additional objects and advantages thereof, will best be understood from the following description of a specific embodiment when read in conjunction with the accompanying drawings in which:

DESCRIPTION

Figure 1:
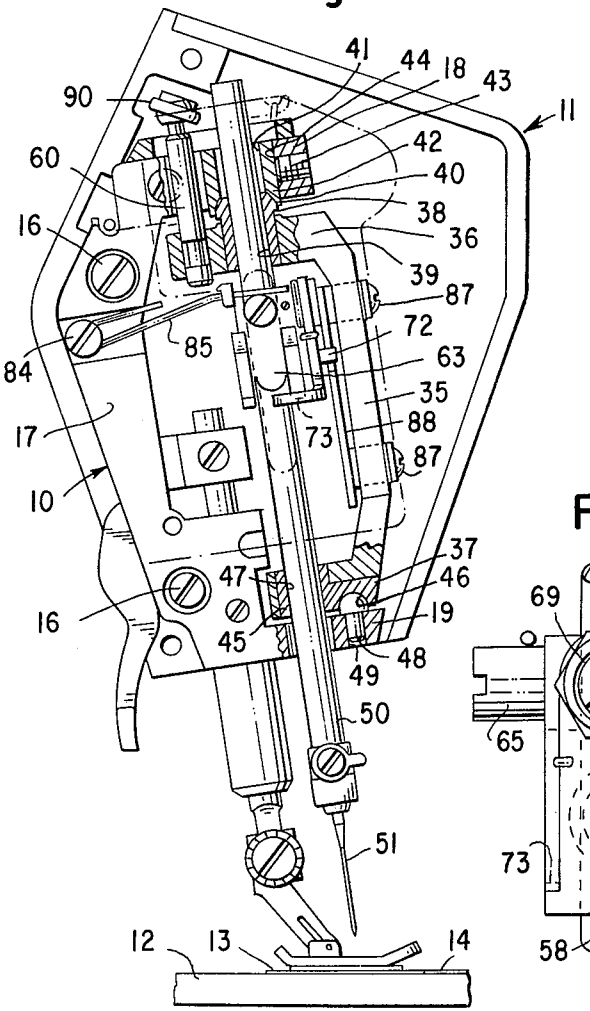
FIG. 1 is a vertical head end view partly in section of a sewing machine showing the arrangement of the gate axis of oscillation to the needle bar axis of reciprocation.

Referring to FIG. 1, there is shown a sewing head 11 of a sewing machine held by an arm and a standard (not shown) in overhanging relation to a bed 12 which contains a throat plate 13 and bed slide 14. Shown attached to the sewing head 11 is a needle bar and gate module 10 which is more fully explained in the U.S. Pat. No. 3,782,311, issued on Jan. 1, 1974 to the assignee of the instant invention, which patent is hereby incorporated herein by reference. As set forth in that patent, the module includes a supporting bracket 17 attached to the sewing head 11 by screws 16, the supporting bracket having forwardly extending upper arm 18 and lower arm 19 straddling a gate 35 having rearwardly extending upper arm 36 and lower arm 37. Into the rearwardly extending upper arm 36 of gate 35 is inserted an upper bearing 38 having both an internal bearing surface 39 and an outer spherical surface 40 in coaxial relationship. The forwardly extending upper arm 18 of the supporting bracket 17 contains a socket bearing 42 having an enlarged central hole 41, the socket bearing 42 being retained in a bore 44 of the support bracket by a screw 43. The rearwardly extending lower arm 37 of the gate 35 supports a lower bearing 45 having a socket bearing surface 46 and an internal bearing surface 47 spaced from the socket bearing surface 46. The spherical head of a pivot stud 48 contained in a bore 49 in the lower forwardly extending arm 19 of the supporting bracket 17 is received in the socket bearing surface 46 of the lower bearing 45. A needle bar 50 reciprocates within upper bearing 38 and lower bearing 45 of the needle bar gate 35. A driving post 60 is affixed to the rearwardly extending upper arm 36 of the gate 35 and extends through a slot in the supporting bracket 17 for oscillation of the needle bar gate 35 on socket bearing 42 and pivot stud 48 as will be explained below. The needle bar 50 extends through slots in the forwardly extending upper arm 18 and the forwardly extending lower arm 19 of the supporting bracket 17 so as to permit free lateral motion thereof within a limited range.

Figure 2:
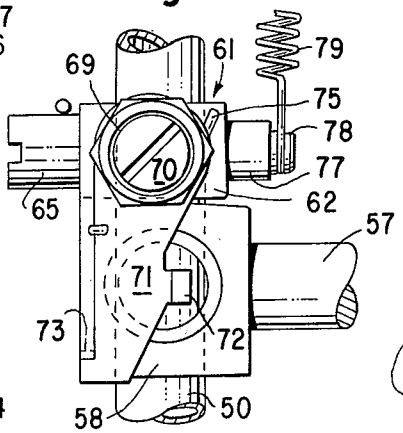
FIG. 2 is a detached front elevation of the latch mechanism attached to the needle bar.

A latch mechanism 61 is affixed to the needle bar 50 in its upper portion (see FIGS. 1 and 2). A rectangular collar 62 having a downwardly extending tang 63 which is received in the bifurcated portion 58 of a driving stud 57, contains a threaded hole which receives a screw 65 having an elongated head portion. The screw 65 extends through the threaded hole in the rectangular collar 62 and firmly attaches the collar to the needle bar 50. Located on the front side of the rectangular collar 62 and supported on an eccentric collar 69, held positioned to the rectangular collar by a screw 70, is a latch lever 71. The latch lever 71 has a forwardly extending ear 72 spaced from the eccentric collar 69 and a rearwardly extending lug having a latch surface 73 located a sufficient distance from the eccentric collar 69 to grip the lower edge of the bifurcated portion 58 of the driving stud 57 when the bifurcated portion 58 is in intimate contact with the lower surface of the rectangular collar 62. Adjustments for proper clearance between the latch surface 73 and bifurcated portion 58 are provided for by rotation of the eccentric collar 69 on which latch lever 71 is supported and tightening of the screw 70 to hold the eccentric collar 69 in the selected adjusted position.

Also supported by eccentric collar 69 and biased on the rectangular collar 62 is a torsion spring 75. The torsion spring 75 biases the latch lever 71 in counterclockwise direction, as viewed in FIG. 2, thereby to engage the rearwardly extending latch surface 73 onto the bifurcated portion 58 of the driving stud 57. Opposite the screw 65 of the rectangular collar 62 is a post 77 extending from the collar 62, which post 77 contains a peripheral groove 78 on its end. The peripheral groove 78 receives one end of a needle bar elevating spring 79, the other end of which is supported on the sewing machine frame. The spring 79 serves to elevate the needle bar 50 whenever the latch surface 73 is disengaged from the bifurcated portion 58 of the driving link 57. A recoil spring 85 is attached by screw 84 to the supporting bracket 17. The purpose of the recoil spring 85 is to prevent the needle bar 50 from being pulled to a height by the needle bar elevating spring 79 which would preclude relatching. To accomplish this objective, the recoil spring 85 bears on the elongated head portion of screw 65 to retain the needle bar 50 in a position which will permit relatching of the needle bar to the driving stud 57 at the uppermost sliding excursion of the driving stud 57 on the needle bar 50.

The gate 35 has attached thereto by screws 87 to the front thereof a latch release abutment member 88 which extends around the gate 35 to the inside thereof adjacent the forwardly extending ear 72 of the latch lever 71. As explained in U.S. Pat. No. 3,782,311, movement of the gate 35 on its outer spherical bearing 40 and pivot stud 48 across the front of the latch mechanism 61 will cause the latch release abutment member 88 to have a portion thereof strike the forwardly extending ear 72 of the latch lever 71 and separate the latch surface 73 of the rearwardly extending lug from the lower edge of the bifurcated portion 58 of the driving stud 57, thus permitting the needle bar elevating spring 79 to draw the needle bar 50 into a position where the elongated head portion of the screw 65 abuts the recoil spring 85.

Figure 3:
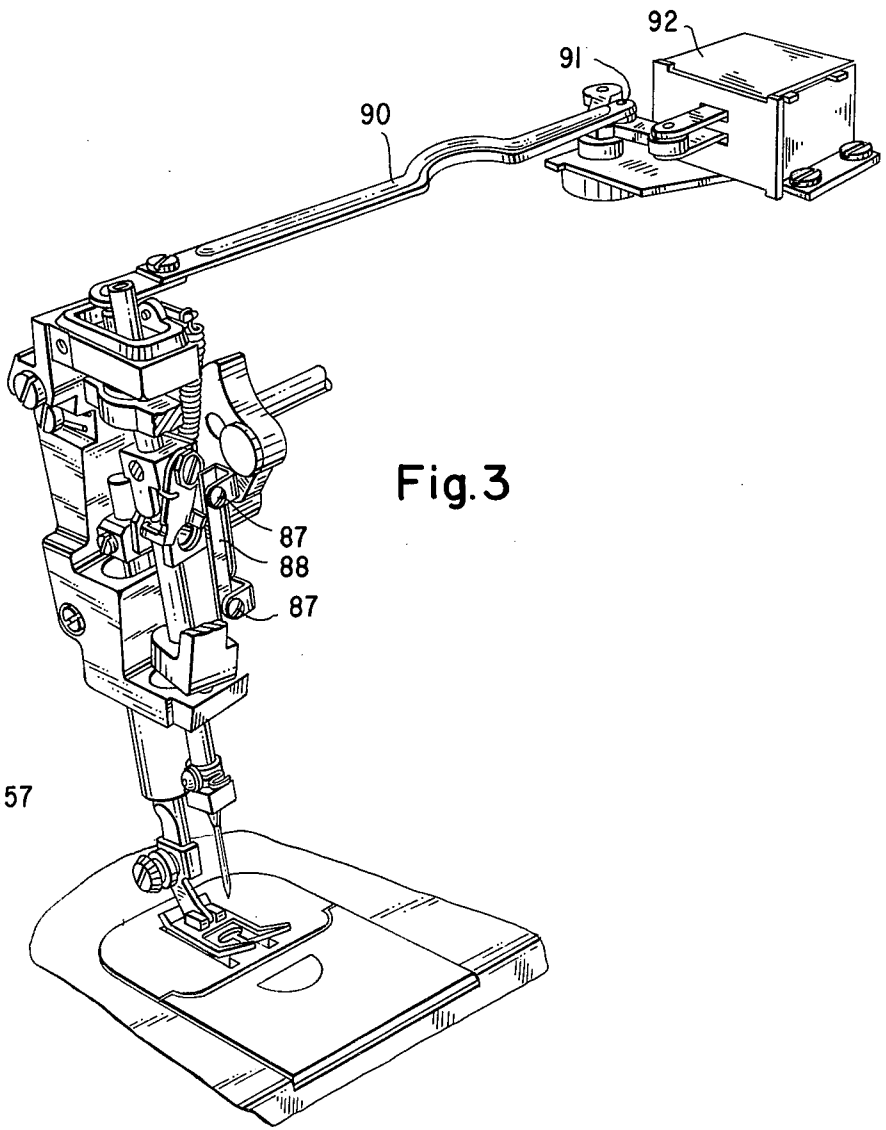
FIG. 3 represents a perspective view of the mechanism of this invention including only portions of the salient mechanisms of a sewing machine and illustrating the needle bar latch being driven into the disconnected position.
Figures 4, 5:
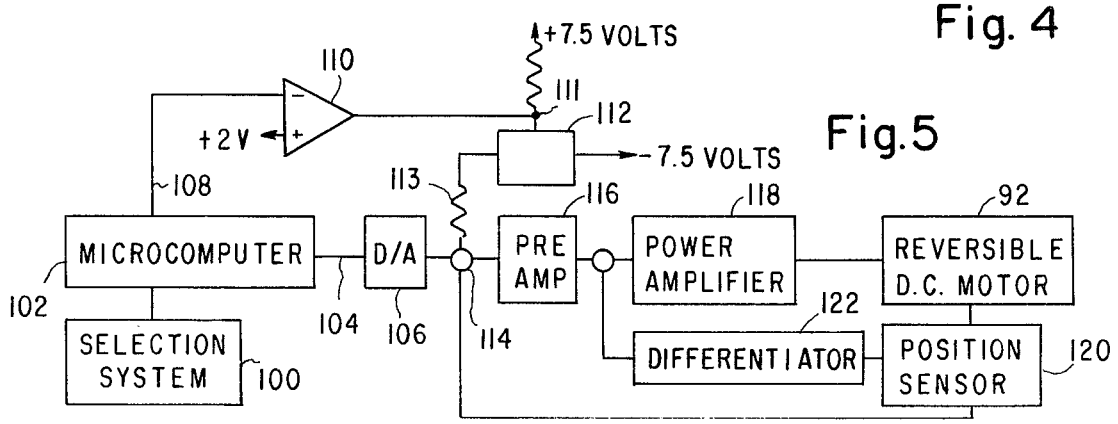
FIG. 4 is a logic code table indicating the number of available positions for sewing machine bight and the voltage level for the bight linear motor that these positions represent.
FIG. 5 is an electronic block diagram indicating the implementation of the invention.

In order to have the gate 35 of the needle bar and gate module 10 move to the position just described so as to disconnect the needle bar 50 from the driving stud 67, the driving post 60 must be urged by a driving link 90 to the right as viewed in FIG. 3 and beyond the normal range of jogging motion for the sewing needle 51. As indicated in the above referenced patent, this was accomplished by utilizing a cam having a deeper valley for the motion beyond the normal right needle position. In this case the end of the driving link 90 opposite the driving post 60 is connected to a pivot pin 91 of a linear motor 92 which is supported in the sewing machine frame. However, the 5 bit system presently used to determine all possible needle positions is inadequate to provide the necessary overshoot of the linear motor to disconnect the needle bar 50 from the driving stud 57. In FIG. 4 there is provided a table indicating the 32 position capability available from 5 bits and the presently used 25 needle positions required to adequately define ornamental patterns. Thus, for full left needle position, a voltage of +0.960 volts will actuate the linear motor 92 to move the driving link 90 to the left as viewed in FIG. 3 so as to place the sewing needle 51 in the extreme left position. The zero voltage applied to the linear motor 92 provides for center needle position of the sewing needle 51, and −0.960 volts applied to the linear motor 92 will move the sewing needle 51 to the full right needle position. In order to retain full flexibility for subsequent alterations in the bight capability of the sewing machine, the 25 needle positions are approximately centered on the 32 available positions. However, approximately −1.5 volts are required for overthrow of the gate 35 sufficient to cause the needle bar 50 to be separated from the driving stud 57. The presently available 32 positions are inadequate to provide this voltage level.

In order to provide the capability for utilizing a linear motor 92 to effectuate a basting stitch, the circuitry of FIG. 5 is provided. In FIG. 5 a selection system 100 is provided from which selection may be made of ornamental patterns, or stitch functions such as basting, single pattern, mirror image or double needle operation. Selection of an ornamental pattern will cause actuation of the basting stitch mechanism for the first stitch in order to prevent the placement of an erroneous stitch, as is taught in U.S. Pat. No. 3,847,100 issued on Nov. 12, 1974. A skip stitch operation is also initiated at the completion of an ornamental pattern if the single pattern functional selection has also been made. Selection of a pattern or function is analyzed by a microcomputer 102 and proper instructions are passed along line 104 to a digital-to-analog converter 106. In the event that a skip stitch signal is required, the microcomputer 102 will pass along a center needle position signal to the digital-to-analog converter 106 along line 104, and a second signal will pass along line 108 to a level shifter 110. The output of the level shifter 110 is applied to the gate of a solid state switch 112 which will close to apply a regulated voltage to a summing point 114 at the input to a servo amplifier system composed of a preamp 116, power amplifier 118 and reversible linear motor 92, which reversible motor 92 carries a position sensor 120 for feedback to a differentiator 122 and to the summing point 114.

The center needle position signal is fed to the digital-to-analog converter 106 so as to have the converter provide a zero input to the summing point 114 input to the servo-amplifier for regulating needle position. Another signal, other than that representing center needle position, may be supplied to the digital-to-analog converter 106, it only being necessary to provide for the same signal for each basting stitch and make suitable adjustments to the regulated voltage applied to the solid state switch 112, or to the resistance 113 so that the reversible linear motor 92 will effect separation of the needle bar 50 from the driving stud 57.

During normal stitch formation, the output from the microcomputer 102 along line 108 would be, for example, +5 volts. The level shifter 110 inverts the signal applied to its inverting terminal to provide −7.5 volts at point 111 which would open the switch 112. For basting, imposition of a null voltage by the microcomputer 102 along line 108 to the level shifter 110 will allow the ±7.5 volt bias voltage to close the switch 112 and apply a regulated voltage to the summing point 114 which will provide the reversible linear motor 92 with the −1.5 volts required to position the needle bar gate 35 to a position where it will uncouple the needle bar 50 from the driving stud 57.

In operation, actuation of the linear motor 92 to a position beyond the normal range of zigzag motion will take place at a faster rate than was available with the use of cams in the prior art and will provide approximately three times as much force as was available heretofore, further increasing speed of reaction. With a basting mechanism actuated by a linear motor, the teachings of the U.S. Pat. No. 4,159,002, issued on June 26, 1979 to the same assignee as the instant application may be applied which will permit input signal wave shaping at low speed in order to reduce insofar as possible the noise emanating from the linear motor 92 which becomes more prevelant at low speeds.

In the prior art devices utilizing cams to actuate the disabling of the latch connection of the needle bar to the sewing machine actuating means, the disabling of the latch connection took place on a valley of the cam cut deeper than that required for the normal jogging motion of the needle bar. Therefore, actual motion of the needle bar gate was caused by the spring maintaining the cam follower in contact with the cam. The force available from the spring to effect the necessary motion was limited to a value low enough to prevent wear on the cam. Also, to avoid wear of the cam, the transitions into and out of the basting mode had to be effected gradually. With a linear motor, approximately three times as much force is available to move the needle bar and gate into an unlatching position. More rapid motion is possible with a linear motor than with any practical transition curves required on a cam. The use of a linear motor to provide jogging beyond the normal range so as to implement basting provides a substantial economic benefit over the use of a solenoid as in the prior art. A further advantage in the use of the linear motor lies in the controllability of the speed of motion thereof.

I claim:

1. A basting stitch mechanism for an electronically controlled sewing machine, said basting stitch mechanism comprising:

a frame, an actuating mechanism carried by said frame, a needle carrying needle bar carried by said frame for endwise reciprocation and for lateral jogging movement for the formation of zigzag stitches, means on said sewing machine establishing a predetermined range of lateral jogging positions of said needle bar in which it is possible for stitches to be formed, means driven by said actuating mechanism for imparting endwise reciprocation to said needle bar, a latching means carried by said needle bar for connecting said needle bar to said endwise reciprocating means therefor, means for disengaging said latching means from said endwise reciprocating means upon a jogging movement beyond said predetermined range of lateral jogging positions, means including a linear actuator and an electronic system therefor for imparting lateral jogging movement to said needle carrying bar within said predetermined range of lateral jogging positions, and means for selectively urging said linear actuator beyond said predetermined range.

2. A basting stitch mechanism as claimed in claim 1 wherein said electronic system comprises a selection system, a microcomputer responding to a selection from said selection system to provide information to a digital-to-analog converter for actuating a servoamplifier to energize said linear actuator and thereby position said needle carrying needle bar, said selective urging means being implemented by said microcomputer responsive to the need for basting to provide a first specific signal to said digital-to-analog converter for presentation of a second specific signal to said servoamplifier, a level shifter, a switch said microcomputer concurrently providing a third specific signal to said level shifter, said level shifter responding to said third specific signal for actuating said switch, said switch upon actuation thereof applying a reference voltage for summing with said second specific signal, whereby said servoamplifier will urge said linear actuator beyond said predetermined range thereby to actuate said disengaging means for disengaging said latching means from said endwise reciprocating means for said needle bar.

* * * * *